US011845277B2

(12) United States Patent
Sato et al.

(10) Patent No.: US 11,845,277 B2
(45) Date of Patent: Dec. 19, 2023

(54) INKJET HEAD, METHOD OF MANUFACTURING INKJET HEAD, AND INKJET RECORDING METHOD

(71) Applicant: Konica Minolta, Inc., Tokyo (JP)

(72) Inventors: Yohei Sato, Hachioji (JP); Akihisa Shimomura, Atsugi (JP); Hiroaki Kozai, Kodaira (JP)

(73) Assignee: KONICA MINOLTA, INC., Tokyo (JP)

( * ) Notice: Subject to any disclaimer, the term of this patent is extended or adjusted under 35 U.S.C. 154(b) by 14 days.

(21) Appl. No.: 17/422,332

(22) PCT Filed: Jan. 11, 2019

(86) PCT No.: PCT/JP2019/000697

§ 371 (c)(1),
(2) Date: Jul. 12, 2021

(87) PCT Pub. No.: WO2020/144850

PCT Pub. Date: Jul. 16, 2020

(65) Prior Publication Data

US 2022/0105727 A1 Apr. 7, 2022

(51) Int. Cl.
*B41J 2/14* (2006.01)
*B41J 2/16* (2006.01)

(52) U.S. Cl.
CPC ..... *B41J 2/14233* (2013.01); *B41J 2/162* (2013.01); *B41J 2/1606* (2013.01); *B41J 2/1628* (2013.01);
(Continued)

(58) Field of Classification Search
CPC ..... B41J 2/14233; B41J 2/1606; B41J 2/162; B41J 2/1628; B41J 2/1642; B41J 2/1646;
(Continued)

(56) References Cited

U.S. PATENT DOCUMENTS 5,136,310 A 8/1992 Drews
2007/0221617 A1 9/2007 Takahashi

FOREIGN PATENT DOCUMENTS

JP 4234663 A 8/1992
JP H10217484 A 8/1998
(Continued)

OTHER PUBLICATIONS

IP.com search (Year: 2022).*
"XPS analysis of SiC films prepared by radio frequency plasma sputtering", Section 3.5 "XPS analysis of SiC films", Figs. 6(a)-6(b) and caption (Year: 2012).*
(Continued)

*Primary Examiner* — Lisa Solomon
(74) *Attorney, Agent, or Firm* — CANTOR COLBURN LLP

(57) ABSTRACT

Provided is an inkjet head containing a nozzle plate having at least a substrate, wherein the nozzle plate has a liquid-repellent layer on an outermost surface of the substrate on an ink ejection surface side; a liquid-repellent layer base film is provided between the substrate and the liquid-repellent layer; and the liquid-repellent layer base film contains at least silicon (Si) and carbon (C), and having a maximum peak P of a binding energy of a Si2p orbital of a surface portion measured by X-ray photoelectron spectroscopy is in the range represented by the following Formula (1), Formula (1): 99.6 (eV)≤P≤101.9 (eV).

7 Claims, 8 Drawing Sheets

(52) U.S. Cl.
CPC ..... *B41J 2/1642* (2013.01); *B41J 2/1646* (2013.01); *B41J 2002/14258* (2013.01); *B41J 2202/20* (2013.01)

(58) Field of Classification Search
CPC ..... B41J 2002/14258; B41J 2202/20; B41J 2/1634; B41J 2/1645
See application file for complete search history.

(56) References Cited

FOREIGN PATENT DOCUMENTS

| | | | |
|---|---|---|---|
| JP | 2007253479 | A | 10/2007 |
| JP | 200978439 | A | 4/2009 |
| JP | 2015003483 | A | 1/2015 |
| JP | 6217170 | B2 | 10/2017 |

OTHER PUBLICATIONS

EPO Extended European Search Report for corresponding EP Application No. 19909603.9; dated Dec. 17, 2021.
International Search Report for corresponding International Application No. PCT/JP2019/000697; dated Feb. 19, 2019.
CNIPA 1st Office Action for corresponding CN Application No. 201980088657.9; dated Apr. 6, 2022.
CNIPA Office The Second Office Action/Search Report for corresponding CN Application No. 201980088657.9; dated Aug. 12, 2022.
JPO Notice of Reasons for Refusal for corresponding JP Application No. 2020-565137; dated Sep. 6, 2022.
PCT International Preliminary Report on Patentability with Written Opinion of the International Searching Authority for International Application No. PCT/JP2019/000697; dated Jun. 16, 2021.
EPO Communication pursuant to Article 94(3) EPC for corresponding EP Application No. 19909603.3; dated Nov. 2, 2023.

* cited by examiner

INKJET HEAD, METHOD OF MANUFACTURING INKJET HEAD, AND INKJET RECORDING METHOD

CROSS REFERENCE TO RELATED APPLICATIONS

This is the U.S. national stage of application No PCT/JP2019/000697, filed on Jan. 11, 2019; the entire contents of which are incorporated herein by reference.

TECHNICAL FIELD

The present invention relates to an inkjet head, a method of manufacturing an inkjet head, and an inkjet recording method. Specifically, the present invention relates to an inkjet head having a nozzle plate with excellent ink resistance and adhesion, a method of manufacturing the same, and an inkjet recording method capable of obtaining a high-grade inkjet recording image using the same.

BACKGROUND

Conventionally, an inkjet recording method has been proposed in which ink droplets are ejected from a nozzle of an inkjet head to form an inkjet image on a recording medium.

In the inkjet head, when ink droplets are ejected, the ink may adhere to the ejection surface of the nozzle (around the ejection side opening of the nozzle) due to the influence of ink mist generated in the inkjet recording apparatus, or bouncing of the ink from the recording medium. It is known that when the ink adheres to the ejection surface and blocks the vicinity of the ejection port, the ejection angle of the ink is bent. As a means for suppressing the adhesion of the ink to the nozzle surface, a liquid-repellent layer is generally formed on the nozzle surface.

As a constituent material of the liquid-repellent layer, a material of a type called a silane coupling agent is often selected. This silane coupling agent exhibits excellent repellency even in an extremely thin film (ideally in a monomolecular film form), and is characterized in that high adhesion may be obtained by forming a siloxane bond ("substrate"—"Si—O—Si"—"liquid-repellent group") with the substrate. Particularly, in recent years, in order to improve the landing accuracy of the ink, from the viewpoint that the effect of the ink ejection performance is hardly exerted, there are many examples in which an extremely thin liquid-repellent layer is provided on the nozzle plate with a silane coupling agent.

One of the problems in the liquid-repellent layer constituted by such a silane coupling agent is ink resistance. It has become apparent that when the liquid-repellent layer is exposed to an ink for a long time, the liquid repellency decreases. In particular, when the ink to be applied is an alkaline ink, the phenomenon appears remarkably.

As the present inventor has been studying the cause thereof, it has been found that a liquid-repellent layer base film constituting a nozzle plate is eroded by an ink, particularly an alkaline ink. In the liquid-repellent layer formed of the silane coupling agent, it is common to use $SiO_2$ as the liquid-repellent layer base film for forming a siloxane bond, but it has been found that the liquid-repellent layer is peeled off and falls off because $SiO_2$ components are dissolved by the inks, and the liquid-repellency is lowered.

For the above-described problem, a nozzle member having a surface treatment film (corresponding to a liquid-repellent layer base film) in which Si and a transition metal are bonded via oxygen atoms on a substrate and an organic liquid-repellent film formed thereon is disclosed (for example, see Patent Document 1). According to this method, it is said that the ink resistance reliability of the interface between the liquid-repellent layer base film and the substrate may be improved. However, in the method disclosed in Patent Document 1, although a higher ink resistance may certainly be obtained as compared with $SiO_2$ components, since the liquid-repellent layer base film has the same chemical bond structure as that of $SiO_2$, it becomes clear that the liquid-repellent layer base film is gradually eroded by the alkaline ink, in particular, starting from the structural part thereof, and the inkjet recording method using the alkaline ink still has problems.

PRIOR ART DOCUMENTS

Patent Document

Patent Document 1: Japanese Patent No. 6217170

SUMMARY OF THE INVENTION

Problems to be Solved by the Invention

The present invention has been made in view of the above problems and status, and an object of the present invention is to provide an inkjet head having a nozzle plate excellent in ink resistance and adhesion, a manufacturing method thereof, and an inkjet recording method using the same, which may obtain an inkjet recording image of high quality.

Means to Solve the Problems

As a result of intensive investigation in view of the above problems, the present inventor has found the following. That is, an inkjet head having an ink resistance, in particular, a nozzle plate excellent in resistance to an alkaline ink and in adhesion to an alkaline ink can be realized by an inkjet head including a nozzle plate having at least a substrate, a liquid-repellent layer base film and a liquid-repellent layer, wherein the liquid-repellent layer base film contains at least silicon (Si) and carbon (C), and a maximum peak of a binding energy of a Si2p orbital of a surface portion measured by X-ray photoelectron spectroscopy is within an inherent range due to a Si—C bond.

In other words, the above problem according to the present invention is solved by the following means.

1. An inkjet head comprising a nozzle plate having at least a substrate, wherein the nozzle plate has a liquid-repellent layer on an outermost surface of the substrate on an ink ejection surface side; a liquid-repellent layer base film is provided between the substrate and the liquid-repellent layer; and the liquid-repellent layer base film contains at least silicon (Si) and carbon (C), and having a maximum peak P of a binding energy of a Si2p orbital of a surface portion measured by X-ray photoelectron spectroscopy is in the range represented by the following Formula (1).

$$99.6\ (\text{eV}) \leq P \leq 101.9\ (\text{eV}) \qquad \text{Formula (1)}$$

2. The inkjet head described in item 1, wherein the liquid-repellent layer forms a siloxane bond with the liquid-repellent layer base film by a silane coupling agent.

3. The inkjet head described in item 1 or 2, wherein the liquid-repellent layer is a monomolecular layer.
4. The inkjet head described in any one of items 1 to 3, wherein the liquid-repellent layer base film is formed using silicon carbide or trimethoxysilane.
5. A method of manufacturing an inkjet head comprising the steps of:

forming a substrate having a nozzle for ejecting an ink;

forming a liquid-repellent layer base film containing at least silicon (Si) and carbon (C) on an ejection surface side of the substrate, and having a maximum peak P of a binding energy of a Si2p orbital of a surface portion measured by X-ray photoelectron spectroscopy in the range represented by the following Formula (1); and forming a liquid-repellent layer on an ejection surface side of the liquid-repellent layer base film to form a nozzle plate.

$$99.6\ (\text{eV}) \leq P \leq 101.9\ (\text{eV}) \qquad \text{Formula (1)}$$

6. The method of manufacturing an inkjet head described in item 5, wherein the liquid-repellent layer base film is formed using silicon carbide or trimethoxysilane.
7. An inkjet recording method comprising the step of performing inkjet image recording using the inkjet head described in any one of items 1 to 5 and an ink.
8. The inkjet recording method described in item 7, wherein the ink is an alkaline ink.

Effects of the Invention

According to the present invention, it is possible to provide an inkjet head having a nozzle plate excellent in ink resistance and adhesiveness, a method for manufacturing the same, and an inkjet recording method capable of obtaining an inkjet recording image of high-quality using the same.

The expression mechanism or action mechanism of the effect of the present invention is inferred as follows.

For example, in the course of examining the durability of a nozzle plate composed of a substrate, a liquid-repellent layer base film, and a liquid-repellent layer, it has been clarified that the liquid-repellent layer base film composing the nozzle plate is eroded by an ink, in particular, by an alkaline ink. In the liquid-repellent layer formed of a silane coupling agent, $SiO_2$ is generally used to form a siloxane bond, but since $SiO_2$ components are dissolved by the ink, the liquid-repellent layer is peeled off and falls off, and it has been found that the liquid repellency is lowered.

As a result of extensive studies on the above problems, the present inventor was able to obtain a nozzle plate excellent in ink resistance and adhesion by forming the liquid-repellent layer base film of the present invention from materials having a Si—C bond structure. In other words, by having a Si—C bond in which Si is directly bonded to carbon, chemical stability is improved, and it is not eroded even for an ink having various characteristics such as an alkaline ink, and it is possible to form a chemical bond (siloxane bond) with the liquid-repellent layer, thereby drastically improving adhesion. Therefore, by the nozzle plate having the configuration defined in the present invention, it was possible to realize an inkjet head including a nozzle plate on which a liquid-repellent layer excellent in durability having both ink resistance and adhesiveness was formed even in an ultrathin film at a monomolecular layer level.

EMBODIMENTS TO CARRY OUT THE INVENTION

Figure 1:
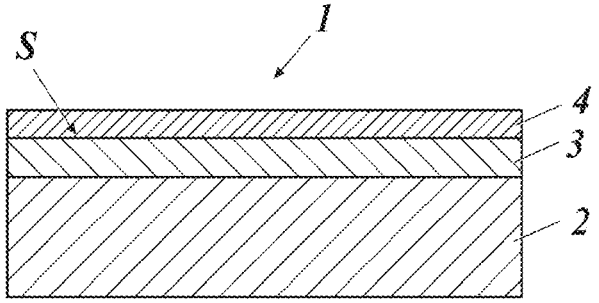
FIG. 1 is a schematic cross-sectional view showing an example of the configuration of a nozzle plate according to the present invention.

The inkjet head is characterized in that it has at least a substrate, a liquid-repellent layer base film, and a liquid-repellent layer, wherein the liquid-repellent layer base film contains at least silicon (Si) and carbon (C), and the maximum peak P of the binding energy of the Si2p orbital of the surface portion measured by X-ray photoelectron spectroscopy is within the intrinsic range caused by a Si—C bond. This feature is a technical feature common to the present invention according to each of the following embodiments.

As an embodiment of the present invention, from the viewpoint that an object effect of the present invention may be further exhibited, it is preferable that the liquid-repellent layer can enhance adhesion between the constituent layers by forming a siloxane bond ("substrate"—"Si—O—Si"—"liquid-repellent group") with the liquid-repellent layer base film by a silane coupling agent.

Further, it is preferable that the liquid-repellent layer is a monomolecular layer in view of further expressing an effect by the liquid-repellent layer base film according to the present invention.

In addition, it is preferable that the liquid-repellent layer base film is formed using silicon carbide or trimethoxysilane in that the range of the maximum peak of the binding energy of a Si2p orbital of the surface portion defined in the present invention may be achieved.

As a method of manufacturing an inkjet head, it is characterized in comprising the following steps: a step of forming a substrate having a nozzle for ejecting an ink, a step of forming a liquid-repellent layer base film in which at least silicon (Si) and carbon (C) are contained on an ejection surface side of the substrate and the maximum peak P of the binding energy of the Si2p orbital of the surface portion measured by X-ray photoelectron spectroscopy is within an inherent range, a step of forming a liquid-repellent layer on an ejection surface side of the liquid-repellent layer base film to form a nozzle plate, and a step of fabricating an inkjet head comprising the nozzle plate.

In addition, in the inkjet recording method of the present invention, an inkjet head of the present invention and an inkjet recording are performed using an alkaline ink.

Note that the "surface portion of the liquid-repellent layer base film" as used in the present invention refers to a surface which is bonded to the liquid-repellent layer by forming a siloxane bond with the liquid-repellent layer. For example, in the case of a configuration having a "liquid-repellent layer base film" having a specific structure between the substrate and the liquid-repellent layer, it is the surface portion of the liquid-repellent layer base film. On the other hand, in a configuration in which a specific liquid-repellent layer base film is not formed, and the substrate and the liquid-repellent layer are in contact with each other, the substrate corresponds to the liquid-repellent layer base portion, and the surface of the substrate in direct contact with the liquid-repellent layer corresponds to the surface of the liquid-repellent layer base film.

The "nozzle plate" in the present invention means a member composed of at least a substrate (hereinafter, also referred to as a substrate portion), a liquid-repellent layer base film, and a liquid-repellent layer, which are defined in the present invention, and may be referred to as a "nozzle substrate" as a whole.

Hereinafter, the present invention, its constituent elements, and configurations and embodiments for carrying out the present invention will be described in detail. In the present description, when two figures are used to indicate a range of value before and after "to", these figures are included in the range as a lowest limit value and an upper limit value. In the description of each figure, the numbers at the end of the components represent the symbols in each figure.

<<Inkjet Head>>

The inkjet head of the present invention is characterized in that the inkjet head includes a nozzle plate having at least a substrate, wherein the nozzle plate has a liquid-repellent layer on the outermost surface of the substrate on the ink ejection surface side, has a liquid-repellent layer base film between the substrate and the liquid-repellent layer, the liquid-repellent layer base film contains at least silicon (Si) and carbon (C), and the maximum peak P of the binding energy of the Si2p orbital of the surface portion measured by X-ray photoelectron spectroscopy is within the range represented by the following Formula (1).

$$99.6\ (\text{eV}) \leq P \leq 101.9\ (\text{eV}) \qquad \text{Formula (1)}$$

[Basic Configuration of Nozzle Plate]

First, a specific configuration of the nozzle plate according to the present invention will be described with reference to the drawings.

FIG. 1 is a schematic cross-sectional view showing an example of a basic configuration of a nozzle plate provided in the inkjet head of the present invention.

In FIG. 1, a nozzle plate 1 according to the present invention has a configuration in which at least a liquid-repellent layer base film 3 and a liquid-repellent layer 4 are laminated on a substrate 2. The liquid-repellent layer base film 3 contains silicon (Si) and carbon (C), has a Si—C bond, and has a maximum peak P of binding energy of a Si2p orbital of the surface portion measured by X-ray photoelectron spectroscopy (X-ray photoelectron spectroscopy) within a maximum peak P as 99.6 (eV)≤P≤101.9 (eV). Further, the liquid-repellent layer 4 is preferably made of a silane coupling agent, and by forming a siloxane bond represented by "—Si—O—Si—" between the liquid-repellent layer 4 and the liquid-repellent layer base film 3, adhesion between the liquid-repellent layer 4 and the liquid-repellent layer base film 3 is drastically improved, and, for example, even in a long time use using an alkaline ink, erosion and degradation of the constituent layer hardly occur, and a nozzle plate excellent in durability may be obtained.

[Measurement of the Binding Energy of the Si2p Orbital on the Liquid-Repellent Base Film Surface]

In the present invention, as described above, the liquid-repellent layer base film constituting the nozzle plate according to the present invention contains at least silicon (Si) and carbon (C), and the maximum peak P of the binding energy of the Si2p orbital of the surface portion measured by X-ray photoelectron spectroscopy falls within the range of 99.6 (eV)≤P≤101.9 (eV).

The binding energy of the Si2p orbital of the surface portion measured by X-ray photoelectron spectroscopy will be described below.

In the present invention, the binding energy of the Si2p orbital defined in the present invention is measured by X-ray photoelectron spectroscopy.

An X-ray photoelectron spectroscopy (hereinafter also referred to as XPS analysis) is a method of obtaining a spectrum by irradiating soft X-rays to a surface of a sample placed in an ultra-high vacuum and spectral analyzing kinetic energy of inner shell electrons emitted by an external photoelectric effect. The X-ray photoelectron spectroscopy calculates the binding energy between an electron and a nucleus before it is emitted. Since the binding energy shows a value peculiar to the element, and the amount of photoelectron emission increases or decreases in accordance with the element concentration in the measurement region, based on this calculation result, element identification, chemical structure and quantitative analysis may be performed. Specifically, it is possible to specify the atomic composition ratio of an element existing at a depth of a few nanometers near the surface, the bonding state of each atom constituting the material.

In the present invention, specifically, it may be measured using the following method.

As the XPS measuring device, Quantera SXM manufactured by ULVAC-PHI Corporation may be used. A monochromatic Al Kα ray (1486.6 eV) is used as an X-ray source. The detection region is set to 100 μmφ, the extraction angle is set to 45°, and the detection depth is set to a range of about 4 nm to 5 nm for measurement. As the analysis software, PHI Multipak may be used.

Table I shows a maximum peak energy (eV) of a Si2p orbital due to the structural difference in the bonding states of the respective Si.

TABLE I

| Bond structure | Maximum peak P of the binding energy of the Si2p orbital [eV] |
|---|---|
| —Si—Si— | $98.8 < P < 99.6$ |
| —Si—C— | $99.6 \leq P \leq 101.9$ |
| —Si—O—C— | $101.9 < P \leq 102.9$ |
| —Si—O— | $102.9 < P \leq 104.0$ |

As shown in Table I, the maximum peak P of the binding energy of the Si2p orbital shows a specific range due to the difference in the bond between Si and other elements.

The maximum peak P of the binding energy of the Si2p orbital attributable to a Si—C bond defined in the present invention application shows a value within the range of 99.6 (eV)≤P≤101.9 (eV), and when the maximum peak P of the binding energy of the Si2p orbital is within the range shown above, it may be specified that the film is a liquid-repellent layer base film having a structure of a Si—C bond.

Figure 2:
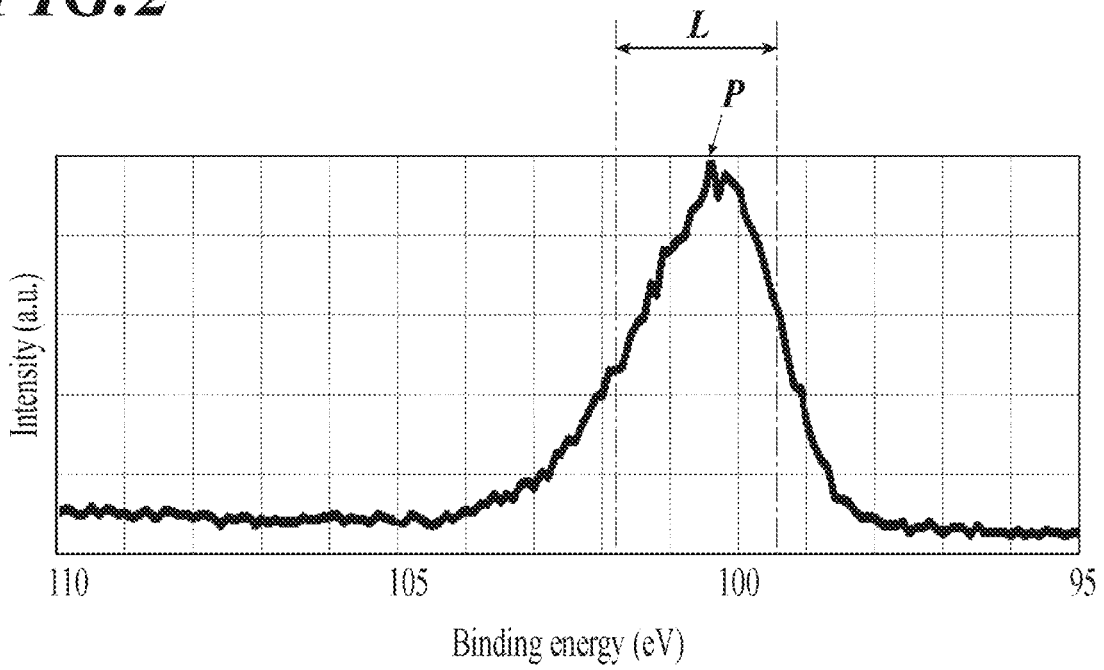
FIG. 2 is a graph showing an example of XPS spectrum of a binding energy of a Si2p orbital of the surface portion of the liquid-repellent layer base film.

Next, a specific measurement example is shown in FIG. 2.

FIG. 2 is a graph showing an exemplary XPS spectrum of the binding energies of the Si2p orbital in the surface portion of the liquid-repellent layer base film.

The XPS spectrum shown in FIG. 2 is an XPS spectrum of the binding energy obtained by measuring a depth of 5 nm from a surface portion of a liquid-repellent layer base film formed by chemical vapor deposition (CVD) on a silicon substrate using trimethylsilane (abbreviation: TMS) as a material for forming a liquid-repellent layer base film by Quantera SXM manufactured by ULVAC-PHI Corporation.

In the XPS spectrum shown in FIG. 2, the horizontal axis represents the binding energy [eV], and the vertical axis represents the Intensity of the photoelectrons [a.u. (in arbitrary units)], where the maximum peak P is 100.4 (eV) at the maximum peak P of the binding energy of the Si2p orbital. L represents the range of 99.6 (eV)≤P≤101.9 (eV) of the maximum peak P of the binding energy of the Si2p orbital defined in the present invention.

[Components of Nozzle Plate]

Next, the details of each element constituting the nozzle plate according to the present invention will be described.

[Substrate]

The substrate applicable to the nozzle plate according to the present invention may be selected from materials having high mechanical strength, ink resistance, and excellent dimensional stability, such as stainless steel, nickel (Ni) or other metal materials, polyimide, polyphenylene sulfide, polyethylene terephthalate, or other organic materials, and silicon (Si).

In the present invention, the substrate may be silicon from the viewpoint of processing accuracy, or a resin substrate or a stainless steel substrate from the viewpoint of ink resistance of the substrate itself.

The thickness of the substrate is not particularly limited, but is usually within a range of 10 to 300 μm, preferably within a range of 20 to 100 μm, and more preferably within a range of 30 to 80 μm.

[Liquid-Repellent Layer Base Film]

In the nozzle plate according to the present invention, a liquid-repellent layer base film is provided between the substrate and the liquid repellent layer described later. The liquid-repellent layer base film contains at least silicon (Si) and carbon (C), and the maximum peak P of the binding energy of the Si2p orbital of the surface portion measured by the X-ray photoelectron spectroscopy is within the range of 99.6 (eV)≤P≤101.9 (eV).

By providing the liquid-repellent layer base film having the characteristics defined in the present invention, a nozzle plate having excellent ink resistance and adhesion may be obtained as described above. That is, since the liquid-repellent layer base film has a Si—C bond in which Si is directly bonded to carbon, chemical stability is drastically improved, corrosion is prevented even with respect to an ink having corrosiveness such as an alkaline ink, and a chemical bond (siloxane bond, Si—O—Si) may be formed with the liquid-repellent layer, whereby adhesion may be enhanced.

As a method of forming the liquid-repellent layer base film constituted by a Si—C bond, the following 2 methods may be mentioned, and may be appropriately selected and used.

The first method is a method of forming a liquid-repellent layer base film having a Si—C bond using trimethoxysilane (abbreviation: TMS) as a forming raw material and argon as a carrier gas, and using a high-frequency discharge plasma CVD (Chemical Vapor Deposition), or a PIG (Penning Ionization Gauge) type plasma CVD. Further, an oxygen gas may be added for the purpose of introducing oxygen into the liquid-repellent layer base film.

The second method is a method of forming a liquid-repellent layer base film having a SiC bond by a sputtering method in which argon is used as a carrier gas with SiC as a target. Further, an oxygen gas may be added for the purpose of introducing oxygen into the liquid-repellent layer base film.

As a high-frequency discharge plasma CVD, a PIG method plasma CVD, and a sputtering method, it is possible to apply a conventionally known method, and there is no particular limitation.

The film thickness of the liquid-repellent layer base film according to the present invention is preferably within a range of 1 to 1000 nm, more preferably within a range of 5 to 300 nm, and still more preferably within a range of 10 to 200 nm.

[Liquid-Repellent Layer]

The liquid-repellent layer according to the present invention has a function of forming the outermost surface layer of the nozzle plate and preventing an ink from adhering to the nozzle surface at the time of inkjet recording.

Although there is no particular limitation on the material for forming the liquid-repellent layer according to the present invention, it is a preferred embodiment that the material has a function of forming a siloxane bond (Si—O—Si) with the liquid-repellent layer base film by a silane coupling agent, and it is a monomolecular layer.

As one of the methods of forming the liquid-repellent layer according to the present invention, a method of forming it using a silane coupling agent may be cited.

A silane coupling agent is a chemical compound represented by $Y_nSiX_{4-n}$ (n=1, 2, or 3). Y is a relatively inert group such as an alkyl group, or a reactive group such as a vinyl group, an amino group, an epoxy group, or a mercapto group. X is composed of a group capable of bonding by condensation with a hydroxy group or adsorbed water on a substrate surface such as a halogen, a methoxy group, an ethoxy group, or an acetoxy group.

An amino-based silane coupling agent may be used as a coupling agent having an amino group. Examples of the amino-based silane coupling agent include N-(2-aminoethyl)-3-aminopropylmethyldimethoxysilane, N-(2-aminoethyl)-3-aminopropyltriethoxysilane, 3-aminopropyltriethoxysilane, 3-triethoxysilyl-N,N-(1,3-dimethylbutylidene)propylamine, N-phenyl-3-aminopropyltrimethoxysilane,1-(3-aminopropyl)-1,3,3,3-pentamethyldisiloxane, and 3-aminopropyltris(trimethylsiloxy)silane.

Further, as a coupling agent having a mercapto group, a coupling agent composed of "mercapto group"—"carbon chain"—"hydroxyl group", for example, 3-mercapto-1-propanol may be used. In addition, a mercapto-based silane coupling agent may be used. As the mercapto-based silane coupling agent, 3-mercaptopropylmethyldimethoxysilane, 3-mercaptopropyltrimethoxysilane, 1,3-bis(mercaptomethyl)-1,1,3,3-tetramethyldisiloxane, or 1,3-bis(3-mercaptomethyl)-1,1,3,3-tetramethyldisiloxane may be used.

On the other hand, as straight-chain fluoroalkylsilanes, for example, Y=$CF_3CH_2CH_2$, $CF_3(CF_2)_3CH_2CH_2$, $CF_3(CF_2)_7CH_2CH_2$ may be mentioned.

The portion of Y may also be a material having a perfluoropolyether (PFPE) group (—$CF_2$—O—$CF_2$—).

Specific examples of the compound having a silane group-terminated perfluoropolyether group include "OPTOOL DSX" manufactured by Daikin Industries, Ltd., examples of the compound having a silane group-terminated fluoroalkyl group include "FG-5010Z130-0.2" manufactured by Fluorosurf Corporation, examples of the polymer having a perfluoroalkyl group include "SF Coat Series" manufactured by AGC Seimi Chemical Co., Ltd., and examples of the polymer having a fluorine-containing heterocyclic structure in the main chain include "SYTOP" manufactured by Asahi Glass Co., Ltd., for example. Further, a mixture of a FEP (4-fluoroethylene-6-fluoropropylene copolymer) dispersion and a polyamideimide resin may be mentioned.

The above-described compounds may be produced by the synthetic methods or by the methods equivalent thereto described in the followings: J. Fluorine Chem., 79(1). 87(1996), Materials Technologies 16(5), 209 (1998), Collect. Czech. Chem. Commun., 44, 750-755, J. Amer. Chem. Soc., 1990, 112, 2341-2348, Inorg. Chem., 10, 889-892, 1971, U.S. Pat. No. 3,668,233, as well as in the publications of JP-A 58-122979, JP-A 7-242675, JP-A 9-61605, JP-A 11-29585, JP-A 2000-64348, and JP-A 2000-144097.

Alternatively, a fluororesin may be applied. Examples thereof include polytetrafluoroethylene (PTFE), a tetrafluoroethylene-perfluoroalkylvinyl ether copolymer (PFA), a tetrafluoroethylene-hexafluoropropylene copolymer (FEP), a tetrafluoroethylene-ethylene copolymer (ETFE), a polychlorotrifluoroethylene (PCTFE), a polyvinylidene fluoride (PVDF), but FEP has a low critical surface tension and excellent liquid repellency, and is preferred in that it has a low melt viscosity at 300 to 400° C., which is a heat treatment temperature, and a uniform film may be formed.

Examples of other fluorine-based compounds include hydrolyzable silane compounds containing fluorine groups described in JP-A 2017-154055, organic fluorine compounds described in WO 2008/120505, and fluorine-containing organometallic compounds.

<<Manufacturing Method of Inkjet Head>>

The method for producing an inkjet head of the present invention includes the following steps:

forming a substrate having a nozzle for ejecting an ink;

forming a liquid-repellent layer base film containing at least silicon (Si) and carbon (C) on an ejection surface side of the substrate, and having a maximum peak P of a binding energy of a Si2p orbital of a surface portion measured by X-ray photoelectron spectroscopy in the following range, 99.6 (eV)≤P≤101.9 (eV); and forming a liquid-repellent layer on an ejection surface side of the liquid-repellent layer base film to form a nozzle plate; and forming an inkjet head provided with the nozzle plate.

Hereinafter, a typical configuration of a nozzle plate according to the present invention provided in an inkjet head and a manufacturing method thereof will be described.

[Typical Configuration of Nozzle Plate]

A configuration example of a nozzle plate (nozzle substrate) that forms a nozzle hole having a configuration defined by the present invention will be described.

Figure 3A:
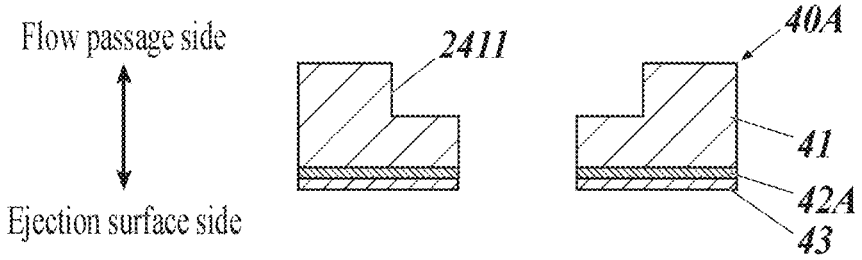
FIG. 3A is a schematic cross-sectional view showing an exemplary configuration of a nozzle plate having a nozzle hole.
Figure 3B:
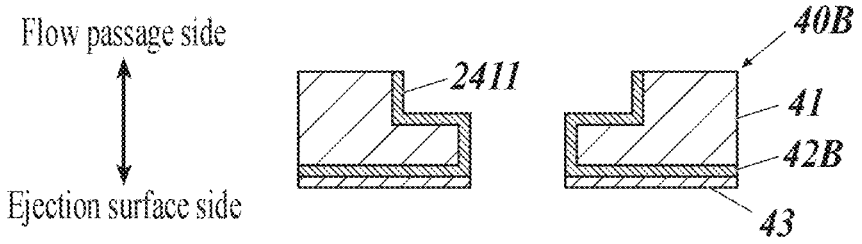
FIG. 3B is a schematic cross-sectional view showing another exemplary configuration of a nozzle plate having a nozzle hole.
Figure 3C:
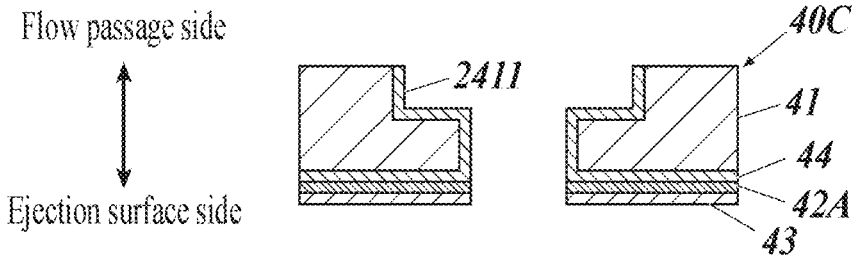
FIG. 3C is a schematic cross-sectional view showing another exemplary configuration of a nozzle plate having a nozzle hole.

FIGS. 3A to FIG. 3C are a schematic cross-sectional view illustrating an exemplary configuration of a nozzle plate having nozzle holes.

The nozzle plate 40A shown in the drawing FIG. 3A has a substrate 41, a liquid-repellent layer base film 42A, and a liquid-repellent layer 43. The substrate 41 is, for example, made of silicon. A nozzle 2411 is a nozzle for ejecting an ink formed on the substrate 41, and includes a flow passage of an ink and a nozzle hole on the ejection surface side. The liquid-repellent layer base film 42A is provided on the side of the ejection surface of the substrate 41, and it is a base layer on the side of the flow passage of the liquid-repellent layer 43, i.e., on the substrate 41 side. The liquid-repellent layer base film 42A is formed of a liquid-repellent layer base film having a Si—C bond, and the liquid-repellent layer 43 is provided on an ejection surface side of the liquid-repellent layer base film 42A, and is formed of, for example, a silane coupling agent, and has liquid repellency (ink repellency).

FIG. 3B is a schematic cross-sectional view of a nozzle-plate 40B. The nozzle plate 40B has a substrate 41, a liquid-repellent layer base film 42B, and a liquid-repellent layer 43. In the configuration of 3B shown in the drawing, the liquid-repellent layer base film 42B is a layer provided on the ejection surface side of the substrate 41 and in the flow passage of the nozzle 2411, and a part thereof serves as a base layer of the liquid-repellent layer 43 on the substrate 41 side.

FIG. 3C is a schematic cross-sectional view of a nozzle-plate 40C. As shown in the drawing 3C, the nozzle plate 40C includes a substrate 41, a flow passage protective film 44, a liquid-repellent layer base film 42A, and a liquid-repellent layer 43. The flow passage protective film 44 is a film which is provided on the ejection surface side of the substrate 41 and in the flow passage of the nozzles 2411, and a part of which becomes a base layer of the liquid-repellent layer base film 42A on the substrate 41 side. The flow passage protective film 44 is a protective film having ink resistance. The material of the flow passage protective film 44 is formed of an oxide of titanium, zirconium, chromium, hafnium, nickel, tantalum, or silicon.

[Method of Manufacturing Nozzle Plate]

Next, the manufacturing process of the nozzle plate 40A (nozzle plate) described with reference to the drawing FIG. 3A will be described with reference to FIG. 4 and FIG. 5A to FIG. 5F.

Figure 4:
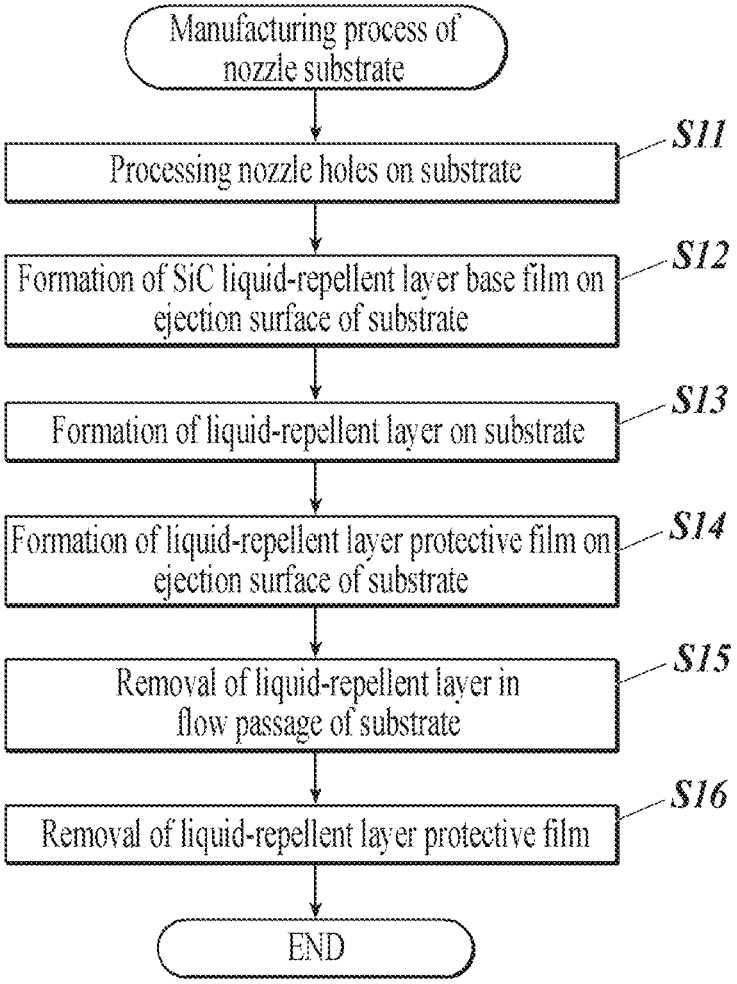
FIG. 4 is a flowchart showing an example of a manufacturing process of the nozzle plate according to the present invention.
Figure 5A:
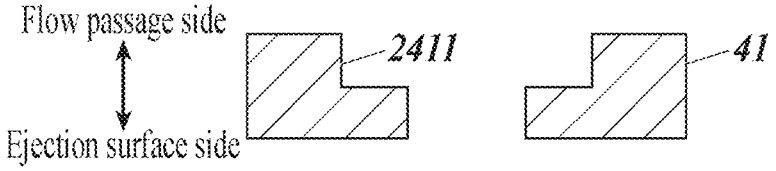
FIG. 5A is a schematic cross-sectional view showing a first step (S11) of a manufacturing process of a nozzle plate according to the present invention.
Figure 5B:
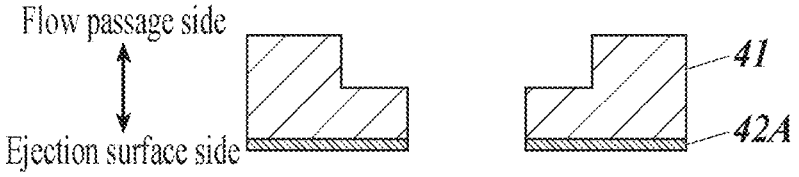
FIG. 5B is a schematic cross-sectional view showing a second step (S12) of the manufacturing process of the nozzle plate according to the present invention.
Figure 5C:
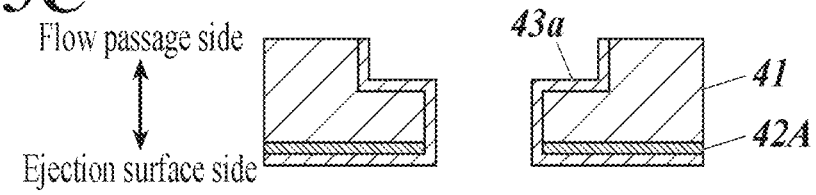
FIG. 5C is a schematic cross-sectional view showing a third step (S13) of the manufacturing process of the nozzle plate according to the present invention.
Figure 5D:
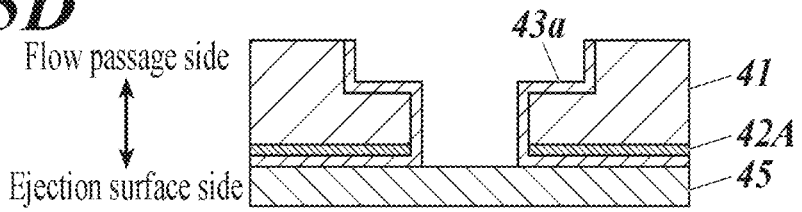
FIG. 5D is a schematic cross-sectional view showing a fourth step (S14) of the manufacturing process of the nozzle plate according to the present invention.
Figure 5E:
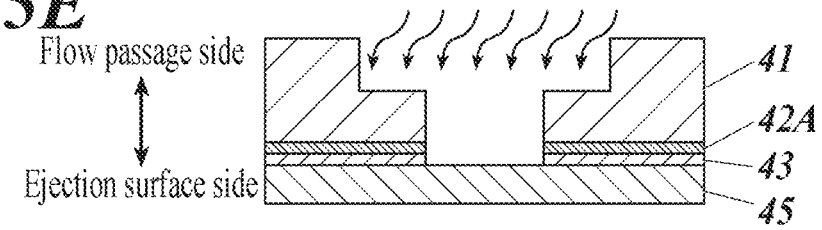
FIG. 5E is a schematic cross-sectional view showing a fifth step (S15) of the manufacturing process of the nozzle plate according to the present invention.
Figure 5F:
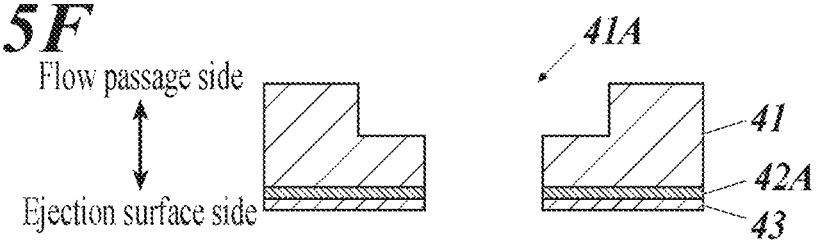
FIG. 5F is a schematic cross-sectional view showing a sixth step (S16) of the manufacturing process of the nozzle plate according to the present invention.

FIG. 4 is a flowchart showing an example of a manufacturing process of the nozzle plate according to the present invention. FIG. 5A is a cross-sectional view schematically showing a substrate 41 having a nozzle hole processing. FIG. 5B is a cross-sectional view schematically showing the substrate 41 on which the liquid-repellent layer base film 42A is formed. FIG. 5C is a cross-sectional view schematically showing the substrate 41 on which the liquid-repellent layer 43*a* is formed. FIG. 5D is a cross-sectional view schematically showing the substrate 41 on which the liquid-repellent layer protective film 45 is formed. FIG. 5E is a cross-sectional view schematically showing the substrate 41 subjected to the liquid-repellent layer removing treatment. In FIG. 5F, the liquid-repellent layer protective film 45 is removed, and the nozzle plate 40A (nozzle substrate) shown in the drawing FIG. 3A is manufactured.

Referring to FIG. 4, a method for manufacturing the nozzle plate 40A shown in FIG. 3A will be described.

(Step S11)

First, as step S11, as shown in FIG. 5A, with respect to the surface of the flow passage side of the silicon-made substrate 41, a resist pattern is provided using a mask corresponding to a position where the nozzle 2411 including the ink flow passage is formed, the nozzle hole and the nozzle flow passage are processed by etching to form a substrate 41 on which the nozzle 2411 is formed.

As the etching method applied in step S11, for example, reactive ion etching (RIE) by the Bosch method, which is easy to excavate deeply, is used. Alternatively, laser drilling, or blasting may be used in combination to form the ink flow passage and the nozzle.

(Step S12)

Next, as step S12, as shown in the drawing 5B, the liquid-repellent layer base film 42A of silicon carbide (silicon carbide membrane) is formed on the ejection surface of the substrate 41 by CVD or sputtering. In forming the liquid-repellent layer base film having a Si—C bond according to the present invention, silicon carbide or trimethoxysilane is preferably used.

After this step S12, it is preferable that the substrate 41 is cleaned and foreign matter is removed. Here, since the substrate 41 is a silicon base, RCA cleaning is suitably used, but other cleaning methods may be used depending on the material of the substrate 41.

(Step S13)

Next, as step S13, as shown in FIG. 5C, a liquid-repellent layer 43*a* is formed on the ejection surface side of the substrate 41 and in the flow passage of the nozzle 2411 by a dip process.

In step S13, in more detail, first, a process of improving the wettability of the surface of the substrate 41 is performed. For example, by performing plasma treatment in an oxygen gas, wettability is improved by forming an OH group on the surface of the liquid-repellent layer base film. Then, a liquid-repellent agent is applied to the substrate 2410 having improved wettability. Here, the liquid repellent agent is applied to the entire surface by immersing the substrate 41 in the liquid-repellent agent (dip coating). As the liquid-repellent agent, for example, a liquid obtained by diluting a silane coupling agent with a solvent is used here. This liquid-repellent agent further contains water as a solvent, and may also contain a surfactant. As a method of coating, a CVD, a spray coating, a spin coating, or a wire bar coating (such as when a siloxane graft type polymer is used) may be used.

Then, the substrate 41 to which the liquid-repellent agent is adhered is left standing under appropriate conditions (temperature and humidity) to form the liquid-repellent layer 43*a*. A chemical bond (siloxane bond) is generated between the liquid-repellent layer and the substrate 41 (liquid-repellent layer base film 42A) based on the above-described plasma treatment and hydrolysis using a silane coupling agent to form a liquid-repellent layer 43*a* in a monomolecular state on the surface of the substrate 41. An appropriate condition is determined depending on the type of the liquid-repellent agent, and is brought into a high temperature state (e.g., 300 to 400° C.) if necessary or at normal temperature, and heat treatment is performed. Then, after the liquid-repellent layer 43*a* is formed on the entire surface of the substrate 41, wash (rinsing) of the substrate 41 on which the liquid-repellent layer 43*a* is formed by a fluorine-based solvent (such as hydrofluoro ether) is performed. At this time, by performing ultrasonic cleaning, the remaining liquid-repellent agent which does not cause chemical bonding is removed. As the frequency of the ultrasonic wave, the MHz band is preferably used. Thus, the liquid-repellent layer 43*a* formed on the surface of the substrate 41 by chemical bonding becomes a monomolecular film that is formed along the shape of the substrate 41.

(Step S14)

Next, as step S14, as shown in FIG. 5D, a liquid-repellent layer protective film 45 such of a masking tape or a resist is formed on the ejection surface side of the substrate 41.

(Step S15)

Then, as step S15, as shown in FIG. 5E, the liquid-repellent layer 43*a* in the flow passage of the substrate 41 in which the liquid-repellent layer protective film 45 is not formed is removed by oxygen-plasma treatment, with leaving the liquid-repellent layer 43.

(Step S16)

Finally, as step S16, as shown in FIG. 5F, the liquid-repellent layer protective film 45 is removed to form the nozzle plate 40A shown in FIG. 3A.

<<Inkjet Recording Method>>

In the inkjet recording method of the present invention, an image recording is performed using an inkjet head comprising the configuration of the present invention and an ink. Further, it is preferable that the ink is an alkaline ink.

Hereinafter, a specific configuration of an inkjet recording apparatus to be applied to an inkjet recording method and an ink represented by an alkaline ink will be described.

(Ink)

There is no particular limitation on the inkjet ink applicable to the inkjet recording method of the present invention. For example, there are various types of inkjet inks, such as an aqueous inkjet ink containing water as a main solvent, and a nonvolatile solvent which does not volatilize at room temperature; an oil inkjet ink which is substantially free of water, and a solvent which volatilizes at room temperature; and an organic solvent inkjet ink which is substantially free of water; a hot melt ink which is printed by heating and melting a solid ink at room temperature; and an active energy ray-curable inkjet ink which is cured by active light rays such as ultraviolet rays after printing. In the present invention, an alkaline ink is preferably applied from the viewpoint that the effect of the present invention may be exhibited.

For example, there are two types of ink, an alkaline ink and an acidic ink, and in particular, an alkaline ink may cause chemical degradation of a water-repellent layer or a nozzle forming surface, but in an inkjet recording method using such an alkaline ink, it is particularly effective to apply an inkjet head provided with a nozzle plate of the present invention. Specifically, the ink applicable to the present invention includes a color material such as a dye or a pigment, water, a water-soluble organic solvent, and a pH adjuster. Examples of the water-soluble organic solvent include ethylene glycol, propylene glycol, diethylene glycol, dipropylene glycol, glycerin, triethylene glycol, ethanol, and propanol. Examples of the pH adjuster include sodium hydroxide, potassium hydroxide, sodium acetate, sodium carbonate, sodium bicarbonate, alkanolamine, hydrochloric acid, and acetic acid.

When sodium hydroxide, potassium hydroxide, sodium acetate, sodium carbonate, sodium bicarbonate, or alkanolamine is used as the pH adjuster, the ink becomes an alkaline ink (liquid) which exhibits alkalinity and may cause chemical damage (chemical degradation) of the water-repellent layer and the nozzle forming surface. The alkaline ink has a pH of 8.0 or more.

As described above, the water-repellent layer 43 is formed of a silane coupling agent, a fluorine-containing organic compound, or a fluorine-containing organosilicon compound. The water-repellent layer 43 has a structure in which a silicon resin and a fluororesin are bonded to each other by a substituent such as a methylene group ($CH_2$). Therefore, the water-repellent layer 43 has a portion (silicon resin) in which silicon (Si) and oxygen (O) are bonded and disposed on the side of the nozzle forming surface, and a portion (fluororesin) in which carbon (C) and fluorine (F) are bonded and disposed on the surface side opposite to the nozzle forming surface 36A, and a portion in which carbon (C) and carbon (C) for bonding the silicon resin and the fluororesin are bonded. Then, a portion (fluororesin) in which carbon (C) and fluorine (F) are bonded is brought into contact with the ink to control the position and shape of the meniscus of the ink.

However, since the binding energy of carbon (C) and carbon (C) is smaller than he binding energy of silicon (Si) and oxygen (O), and the binding energy of carbon (C) and fluorine (F), the portion where carbon (C) and carbon (C) are bonded has weaker bonding and is more susceptible to mechanical damage and chemical damage than the portion where silicon (Si) and oxygen (O) are bonded, and the portion where carbon (C) and fluorine (F) are bonded.

In an inkjet recording method using an alkaline ink which tends to cause such a phenomenon, it is effective to apply a nozzle plate having a configuration defined in the present invention in terms of enhancing durability.

[Inkjet Recording Apparatus]

Next, an inkjet recording apparatus including the nozzle plate of the present invention will be described with reference to the drawings.

An inkjet recording apparatus applicable to the present invention will be described with reference to FIG. 6 and FIG. 7.

Figure 6:
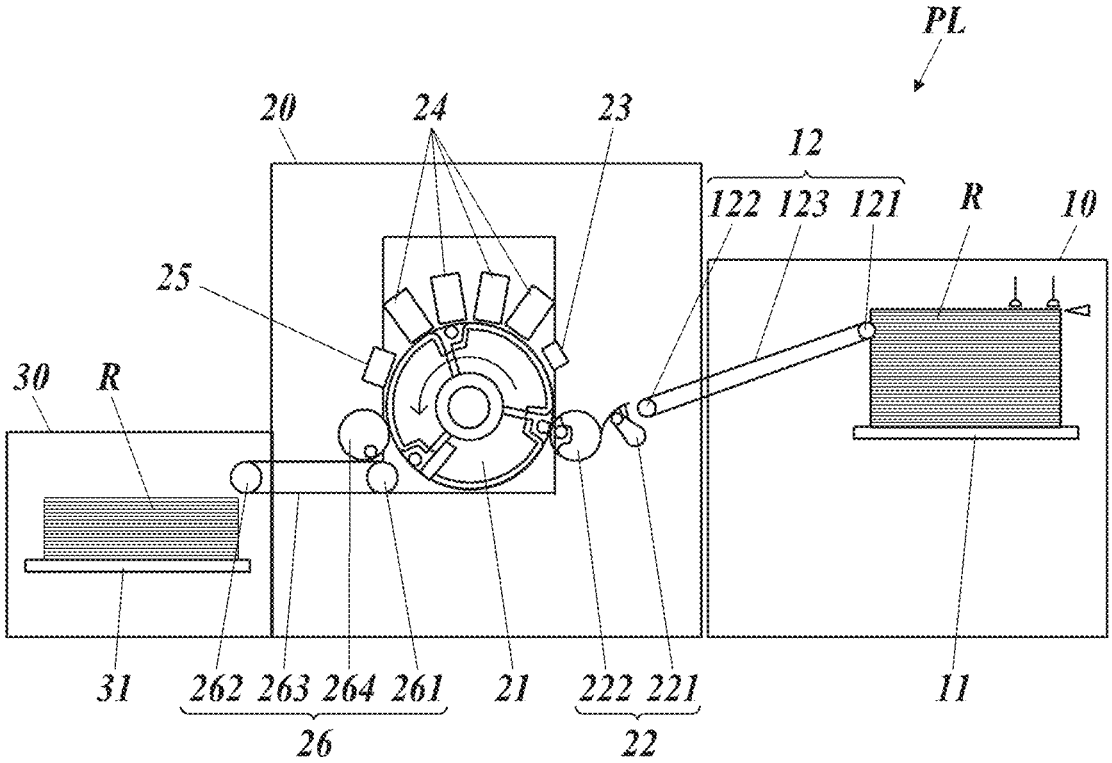
FIG. 6 is a schematic diagram of a configuration of an inkjet recording apparatus applicable to the inkjet recording method of the present invention as viewed from the front.

FIG. 6 is a schematic front view of a configuration of an inkjet recording apparatus PL applicable to the inkjet recording method of the present invention.

The inkjet recording apparatus PL includes a medium supply unit 10, an image forming unit 20, a medium discharge unit 30, and a control unit (not shown). In the inkjet recording apparatus PL, based on the control operation performed by the control unit, the recording medium R stored in the medium supply unit 10 is transported to the image forming unit 20, and after the image is formed, the recording medium R is discharged to the medium discharge unit 30.

The medium supply unit 10 includes a medium supply tray 11 and a conveying unit 12. The medium supply tray 11 is a plate-like member on which one or a plurality of recording media R may be placed. The medium supply tray 11 moves up and down according to the amount of the recording medium R placed, the uppermost one of the recording medium R is held in the conveying start position by the conveying unit 12. As the recording medium R, various types of media such as printing papers, cells, films, and fabrics having various thicknesses that may be curvedly supported on the outer peripheral surface of the image forming drum 21 are used.

The conveying unit 12 includes a plurality of (e.g., two) rollers 121 and 122, a ring-shaped belt 123 supported by rollers 121 and 122 at the inner surface, and a supply unit for delivering the top of the recording medium R placed on the medium supply tray 11 to the belt 123 (not shown). The conveying unit 12 conveys the recording medium R that has been transferred onto the belt 123 by the supply unit in accordance with the rotation of the belts 123 by the rotation of the rollers 121 and 122 and sends the recording medium R to the image forming unit 20.

The image forming unit 20 includes an image forming drum 21, a transfer unit 22, a temperature measuring unit 23, a head unit 24, a heating unit 25, a delivery unit 26, and a cleaning unit.

The image forming drum 21 has a cylindrical outer peripheral shape, carries the recording medium R on the outer peripheral surface (conveying surface), and conveys the recording medium R in a conveying path corresponding to the rotation operation. On the inner surface side of the image forming drum 21, a heater is provided, and the conveying surface may be heated so that the recording medium R placed on the conveying surface becomes a predetermined set temperature.

The transfer unit 22 transfers the recording medium R transferred from the conveying unit 12 to the image forming drum 21. The transfer unit 22 is provided at a position between the conveying unit 12 of the medium supply unit 10 and the image forming drum 21. The transfer unit 22 includes a claw portion 221 for gripping one end of the recording medium R sent by the conveying unit 12, a cylindrical transfer drum 222 for guiding the recording medium R gripped by the claw portion 221. The recording medium R acquired from the conveying unit 12 by the claw portion 221 is moved along the outer peripheral surface of the transfer drum 222 which rotates when sent to the transfer drum 222, and is guided to the outer peripheral surface of the image forming drum 21 as it is and transferred.

The temperature measuring unit 23 is located between the time when the recording medium R is placed on the conveying surface of the image forming drum 21 and the time when the recording medium R is conveyed to a position facing the ink ejection surface (discharge surface) of the first head unit 24, and measures the surface temperature (the temperature of the surface opposite to the surface in contact with the conveying surface) of the recording medium R to be conveyed. As the temperature sensor of the temperature measurement unit 23, for example, a radiation thermometer is used to measure the surface temperature of the recording medium R not in contact with the temperature measuring unit 23 (radiation thermometer) by measuring the intensity distribution of infrared rays. In the temperature measuring unit 23, a plurality of sensors are arranged so that temperatures at a plurality of points may be measured along a width direction (a direction perpendicular to a plane of FIG. 6) perpendicular to a direction (a conveying direction) along a path in which the recording medium R is transported in the image forming unit 20, and the measurement data is output to each control unit at an appropriate timing set in advance and controlled.

The head unit 24 includes a nozzle plate of the present invention, and an image is formed by ejecting (discharging) droplets of the ink from a plurality of nozzle openings (nozzle holes) provided on an ink ejection surface facing the recording medium R to each location of the recording medium R in accordance with rotation of the image forming drum 21 on which the recording medium R is supported. In the inkjet recording apparatus P according to the present invention, the head units 24 are spaced apart from the outer peripheral surface of the image forming drum 21 by a preset distance and are arranged at four predetermined intervals. The four head units 24 output the inks of four colors of C (cyan), M (magenta), Y (yellow), K (black). Here, the inks of the colors C, M, Y, and K are ejected in order from the upstream side in the conveying direction of the recording medium R. As the ink, any one may be used, but here, a normal liquid ink is used, and the ink is fixed to the recording medium R by evaporation and drying of moisture by the operation of the heating unit 25. Each of the head units 24 is here a line head capable of forming an image over an image forming width on the recording medium R in combination with rotation of the image forming drum 21.

The heating unit 25 heats the surface of the conveyed recording medium R. The heating unit 25 has, for example, a heating wire and generates heat in response to energization to heat the air, and also irradiates the recording medium R with infrared rays to heat the recording medium R. The heating unit 25 is disposed in the vicinity of the outer peripheral surface of the image forming drum 21 so as to heat the recording medium R before the recording medium R passes from the image forming drum 21 to the delivery unit 26 after the ink is ejected from the head unit 24 onto the recording medium R conveyed by the rotation of the image forming drum 21. By the operation of the heating unit 25, the ink ejected from the nozzles of the head unit 24 is dried to fix the ink on the recording medium R.

The delivery unit 26 conveys the recording medium R on which the ink is ejected and fixed from the image forming drum 21 to the medium discharging unit 30. The delivery unit 26 includes a plurality of (e.g., two) rollers 261 and 262, an annular belt 263 supported on rollers 261 and 262 at the inner surface, and a cylindrical transfer roller 264. The delivery unit 26 guides the recording medium R on the image forming drum 21 onto the belt 263 by the transfer roller 264, and transfers the transferred recording medium R together with the belt 263 which moves around with the rotation of the rollers 261 and 262 to feed the recording medium R to the medium eject unit 30.

The cleaning unit 27 performs a cleaning operation of the ink ejection surface of the head unit 24. The cleaning unit 27 is disposed adjacent to the image forming drum 21 in the width direction. When the head unit 24 is moved in the width direction, the ink ejection surface of the head unit 24 is set to the cleaning position by the cleaning unit 27.

The medium discharge unit 30 stores the image forming apparatus recording medium R sent out from the image forming unit 20 until the recording medium R is taken out by the user. The medium discharge unit 30 includes a plate-like medium discharge tray 31 on which the recording medium R conveyed by the delivery unit 26 is placed.

Figure 7A:
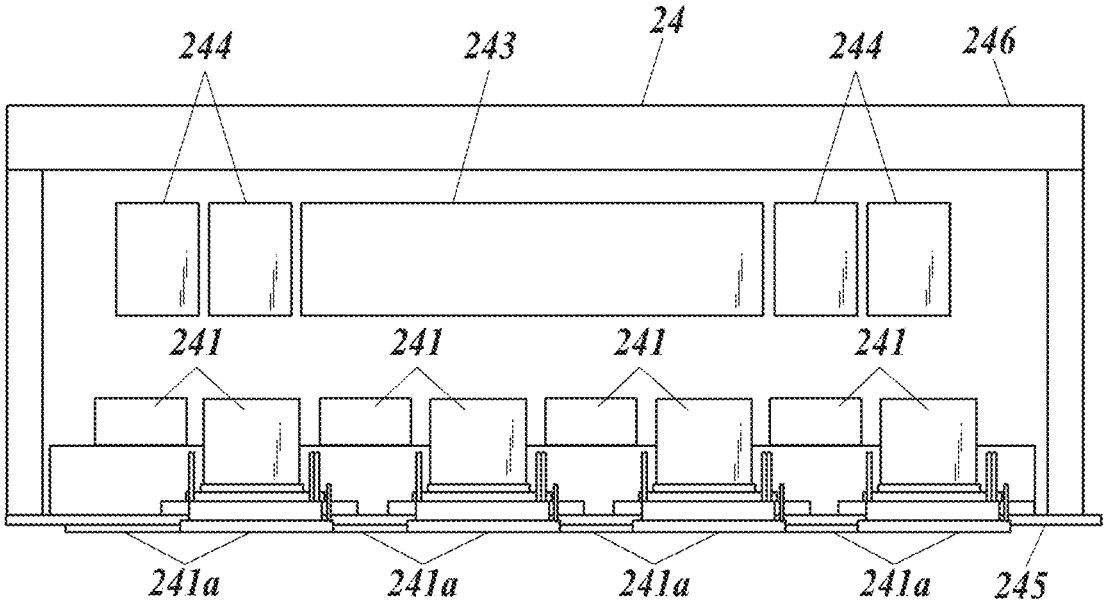
FIG. 7A is a schematic side view of a head unit applicable to an inkjet recording apparatus.
Figure 7B:
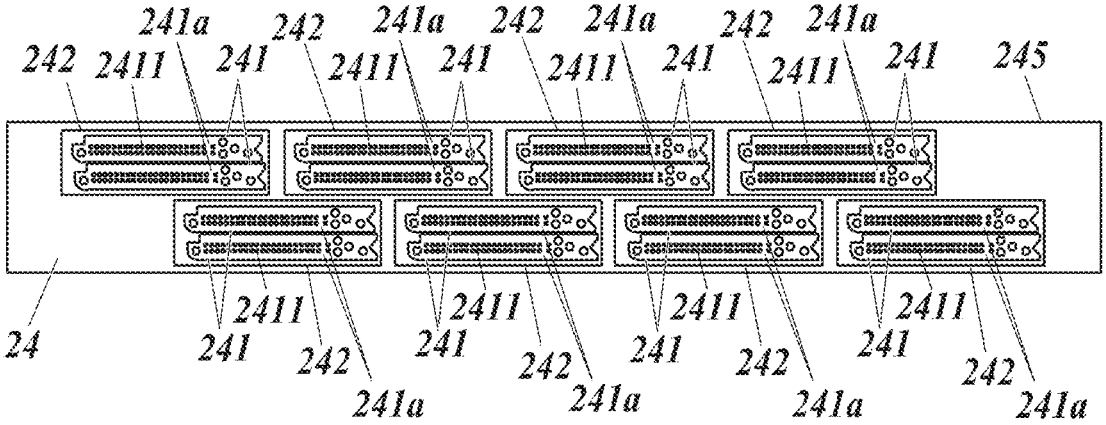
FIG. 7B is a schematic bottom view of a head unit applicable to an inkjet recording apparatus.

FIGS. 7A-FIG. 7B are diagrams showing a configuration of the head unit 24. FIG. 7A is a schematic configuration diagram when the head unit 24 is viewed from the conveying direction upstream side of the recording medium R above the conveying surface of the image forming drum 21. FIG. 7B is a bottom view of the head unit 24 viewed from the conveying surface of the image forming drum 21.

The head unit 24 includes a plurality of inkjet heads 241 having a configuration defined in the present invention. Here, sixteen inkjet heads 241 are provided in one head unit 24, but not limited thereto. The sixteen inkjet head heads 241 are included in a set of eight inkjet modules 242, two each. Here, the inkjet module 242 is adjusted and fixed in a staggered, grid-like relative position here by a fixing member 245.

The fixing member 245 is supported and held by a carriage 246. The carriage 246 also holds a first sub-tank 243 and a second sub-tank 244, and the ink is supplied from the first sub-tank 243 and the second sub-tank 244 to each of the inkjet heads 241. The carriage 246 is independently movable in the width direction on the imaging drum 21 for each of the four head units 24.

As shown in FIG. 7B, the inkjet head 241 has a plurality of nozzles 2411, respectively. The inkjet head 241 ejects the ink (droplets) from the openings (nozzle holes) of the plurality of nozzles 2411 provided on the bottom surfaces (nozzle opening surfaces 241*a*) and lands ink droplets on the recording medium R carried on the conveying surface of the image forming drum 21. Here, as the inkjet head 241, one having a two-dimensional arrangement pattern in which openings are arranged in two rows in each transfer direction is shown, but the present invention is not limited to this. The openings may be arranged in any suitable one-dimensional or two-dimensional array pattern. The arrangement range of the openings covers the recordable width of the recording medium R carried on the conveying surface in the width direction of the entire 16 inkjet heads 241, and the image may be formed in a one-pass manner while the head unit 24 is fixed. The nozzle opening surface 241*a* of the sixteen inkjet heads 241 is covered with the liquid-repellent layer 43.

Figure 8:
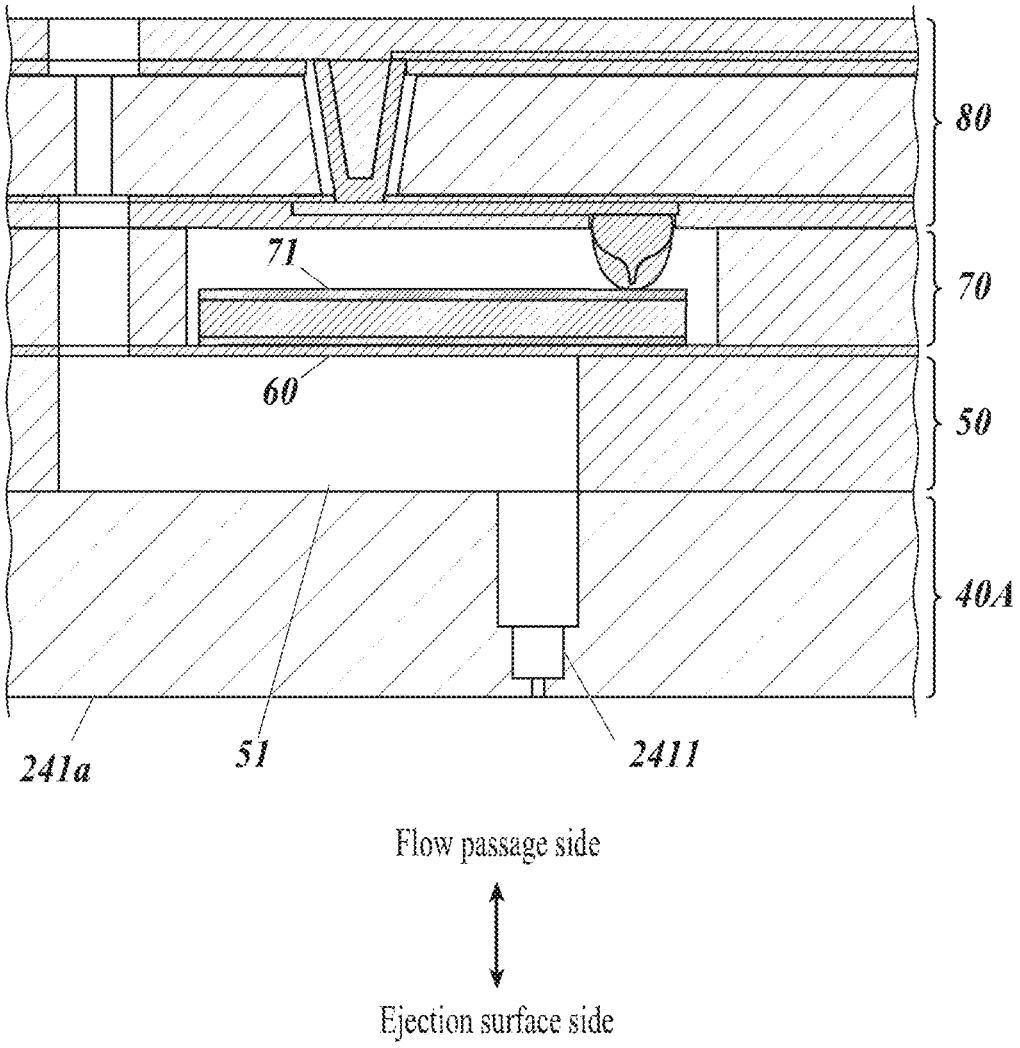
FIG. 8 is a schematic cross-sectional view showing a cross-sectional shape of an inkjet head.

Next, a nozzle plate 40A provided on the ink ejection surface of the head unit 24 described in FIGS. 7A and FIG. 7B will be described in detail. FIG. 8 is a diagram schematically showing a cross-sectional shape of the inkjet head 241.

Each inkjet head 241 is, although not particularly limited, as shown in FIG. 8, a bend mode type inkjet head in which a plurality of plates (substrates) are formed by laminating. Specifically, in the inkjet head heads 241, a nozzle plate 40A, a pressure-chamber substrate 50, a diaphragm 60, a spacer substrate 70, and a wiring board 80 are stacked in this order from the nozzle opening surface 241*a* (ink ejection surface, lower side) to the upper side.

The ink supplied from the first sub-tank 243 and the second sub-tank 244 flows into the pressure chamber 51 of the pressure chamber substrate 50 through the ink flow passage communicated with the wiring board 80, the spacer substrate 70, and the vibration plate 60. The pressure chamber 51 is in contact with the piezoelectric element portion 71 of the spacer substrate 70 via the vibration plate 60, and is also conducted to the nozzle 2411. The control signal from the control unit of the inkjet recording apparatus 1 is input to the piezoelectric element unit 71 through the wiring of the wiring board 80, and the piezoelectric element unit 71 physically vibrates. Thus, the inflow of the ink from the ink flow passage such as the wiring board 80 into the pressure chamber 51 and the outflow of the ink from the pressure chamber 51 to the nozzle 2411 of the nozzle plate 40A are performed. Then, the ink in the nozzle 2411 is ejected as ink droplets from an opening (nozzle hole) on the nozzle opening surface 241*a* (ejection surface) side, and the ink droplets are landed on the recording medium R.

The intermediate substrate (intermediate layer) having a flow passage that conducts from the pressure chamber 51 to the nozzle 2411 may be disposed between the nozzle plate 40A and the pressure chamber substrate 50.

<<Inkjet Head>>

For a detailed configuration of the inkjet head applicable to the present invention, for example, the inkjet head having a configuration descried in the following may be appropriately selected and used: JP-A 2012-140017, JP-A 2013-010227, JP-A 2014-058171, JP-A 2014-097644, JP-A 2015-142979, JP-A 2015-142980, JP-A 2016-002675, JP-A 2016-002682, JP-A 2016-107401, JP-A 2017-109476, and JP-A 2017-177626

EXAMPLES

Hereinafter, the present invention will be specifically described by way of Examples, but the present invention is not limited thereto. In the examples, the indication of "parts" or "%" is used, it indicates "parts by mass" or "% by mass" unless otherwise specified. Each operation was performed at room temperature (25° C.) unless otherwise specified.

<<Preparation of Nozzle Plate>>

[Preparation of Nozzle Plate 1]

A nozzle plate 1 having the structure shown in FIG. 3A was produced in accordance with the process described below.

(1) Preparation of Substrate

As a substrate, a single crystal silicon substrate having a thickness of 100 μm was prepared.

(2) Formation of Liquid-Repellent Layer Base Film 1

Next, on a silicon substrate, a material gas containing an alkyl silicon compound (abbreviation: TMS, tetramethylsilane, $Si(CH_3)_4$)) for forming the liquid-repellent layer base film 1 and argon as a carrier gas were used. A plasma CVD apparatus (plasma CVD apparatus PD-200ST manufactured by SAMCO Corporation) was employed. The flow rate of the material gas (TMS) was set to 30 sccm, the flow rate of the carrier gas (Ar) was set to 10 sccm, the film formation temperature was set to 25° C., and the RF power was set to 500 (W). Thus, the liquid-repellent layer base film 1 with a film thickness of 108 nm was formed.

<Measurement of the Maximum Peak P (eV) of the Binding Energy of the Si2p Orbital of the Liquid-Repellent Layer Base Film and the Atomic Composition Ratio>

The above-described liquid-repellent layer base film 1 was subjected to XPS analysis according to the following conditions.

XPS-measuring device: Quantera SXM manufactured by ULVAC-PHI Corporation

X-ray source: Monochromatic Al Kα (1486.6 eV)

Detection area: 100 μmφ

Take-out angle: 45°

Detection depth: about 4 nm to 5 nm

Figure 9:
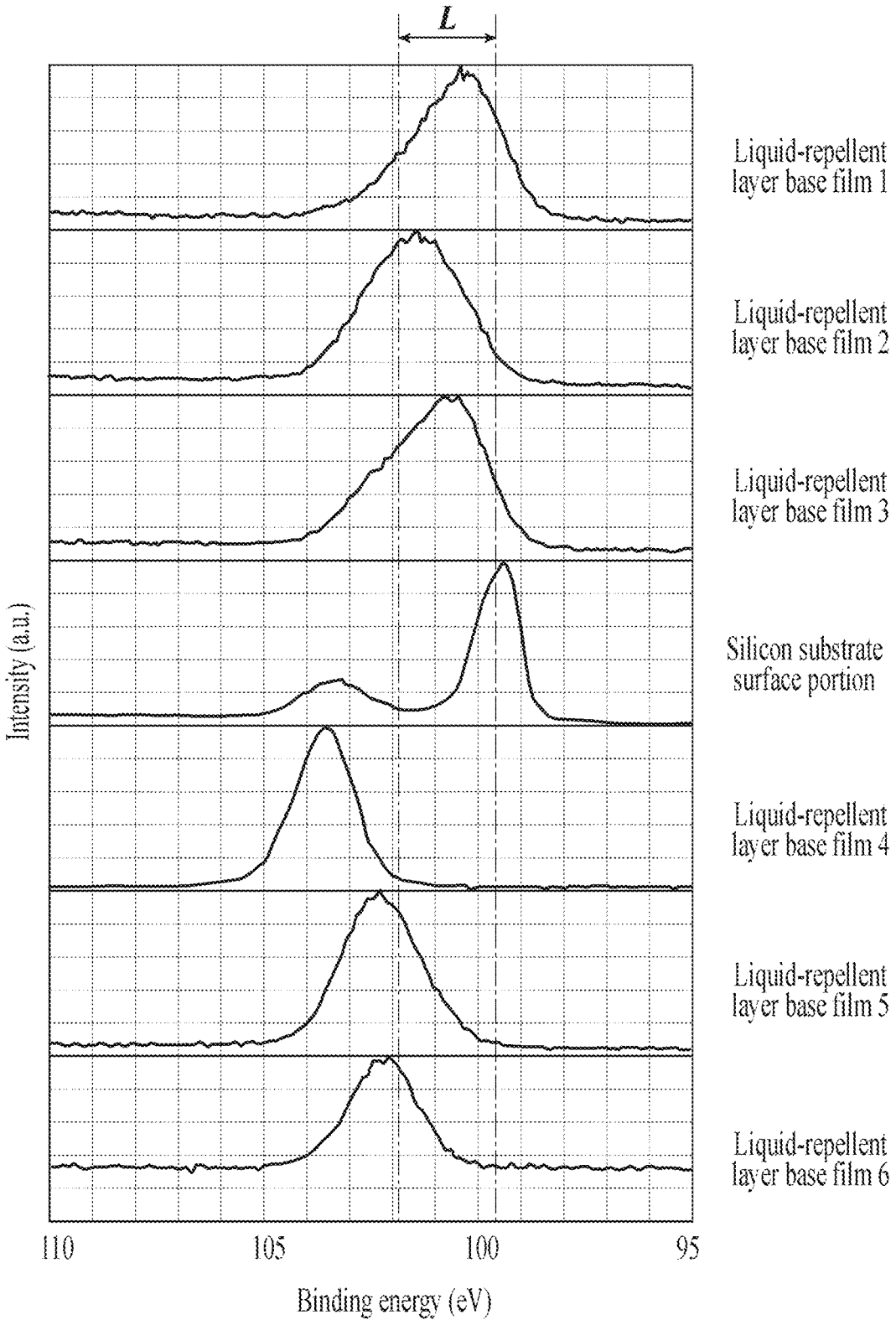
FIG. 9 is a graph showing an XPS spectrum of a binding energy of a Si2p orbital of a surface portion of the liquid-repellent layer base film measured in the example.

As a result of the above measurements, it was confirmed that the maximum peak P (eV) of the binding energies of the Si2p orbital of the liquid-repellent layer base film 1 of the nozzle plate 1 was 100.4 (eV) and the surface of the liquid-repellent layer base film had an "Si—C" bond as shown in FIG. 9.

The atomic composition was as follows: Si=15.3 atomic %, C=65.2 atomic %, and O=19.5 atomic %.

(3) Formation of Liquid-Repellent Layer

Then, a silane coupling compound (OPTOOL DSX manufactured by Daikin Industries, Ltd., a silane group-terminated perfluoropolyether compound) was used as a liquid-repellent layer forming material on the above-formed liquid-repellent layer base film 1, and a liquid-repellent layer having a layer thickness of 5 nm was formed by a spray coating method.

(4) Giving Protective Sheet

A polyethylene terephthalate film having a thickness of 100 μm with a pressure-sensitive adhesive layer composed of a rubber-based pressure-sensitive adhesive on one surface side was prepared as a protective sheet. Then, the liquid-repellent layer of the nozzle plate and the pressure-sensitive adhesive layer of the protective sheet were bonded so as to face each other.

(5) Preparation of Nozzle through Holes and Nozzle Holes

For the nozzle plate having a protective sheet prepared above, as shown in FIG. 5A, with respect to the surface of the flow passage side of the silicon substrate, a resist pattern was provided using a mask according to the position where the nozzle including the ink flow passage was formed. A nozzle hole and a nozzle flow passage were processed to form nozzle holes by etching using reactive ion etching (RIE) by the Bosch method, which facilitates deep digging. Finally, the protective sheet was peeled off to produce a nozzle plate 1.

[Preparation of Nozzle Plate 2]

A nozzle plate 2 was prepared in the same manner as the preparation of the nozzle plate 1 described above except that the liquid-repellent layer base film 1 was changed to the liquid-repellent layer base film 2 formed according to the following method.

(Formation of Liquid-Repellent Layer Base Film 2)

On the silicon substrate, SiC was used as a target material for forming the liquid-repellent layer base film 2, and argon was used as the carrier gas, and a known high-frequency (RF) magnetron type sputtering device was used. A flow rate of the carrier gas (Ar) was set to 20 sccm, the film formation temperature was set to 25° C., the output voltage was set to 0.3 (W). Thus the liquid-repellent base film 2 having a film thickness of 17 nm was formed.

[Preparation of Nozzle Plate 3]

A nozzle plate 3 was produced in the same manner as the preparation of the nozzle plate 2 described above except that the film formation conditions of the liquid-repellent layer base film 2 were appropriately changed and the liquid-repellent layer base film 3 whose film thickness was changed to 70 nm was used.

[Preparation of Nozzle Plate 4]

A nozzle plate 4 was prepared in the same manner as the preparation of the nozzle plate 1 described above except that the formation of the liquid-repellent layer base film 1 was not performed.

[Preparation of Nozzle Plate 5]

A nozzle plate 5 was produced in the same manner as the preparation of the nozzle plate 4 described above except that the silicon substrate was subjected to a thermal oxidization treatment in accordance with the methods described below to form the liquid-repellent layer base film 4 made of $SiO_2$ on the surface of the silicon substrate.

(Formation of Liquid-Repellent Layer Base Film 4 by Thermal Oxidation Process)

The silicon substrate was subjected to a thermal oxidation treatment at a treatment temperature of 850° C. by a wet oxidation method using water vapor to form a liquid-repellent layer base film 4 having a film thickness of 37 nm.

[Preparation of Nozzle Plate 6]

A nozzle plate 6 was produced in the same manner as the preparation of the nozzle plate 1 described above except that the method of forming the liquid-repellent layer base film was changed to the method described below to form the liquid-repellent layer base film 5.

(Formation of Liquid-Repellent Layer Base Film 5)

On the silicon substrates, a material gas containing an alkyl silicon compound (abbreviated as TEOS, tetraethoxysilane, $Si(OC_2H_5)_4$)) for forming the liquid-repellent base film 5 and argon as a carrier gas were used. Using a known plasma CVD device, the flow of the material gas (TEOS) was set to 3 sccm, a flowrate of the carrier gas (Ar) was set to 100 sccc, a depositing temperature was set to 25° C., an output voltage was set to 600 (W), and a film depth was set to 320 nm. Thus the liquid-repellent base film 5 was formed.

[Preparation of Nozzle Plate 7]

A nozzle plate 7 was produced in the same manner as the preparation of the nozzle plate 1 described above except that the method of forming the liquid-repellent layer base film was changed to the method described below to form the liquid-repellent layer base film 6.

(Formation of the Liquid-Repellent Layer Base Film 6)

A liquid-repellent layer base film 6 composed of the atomic composition ratios described in Table II was formed on a silicon substrate using an ALD (Atomic Layer Deposition) film forming method according to the method described in the Examples of Japanese Patent No. 6217170 and using pentadimethylamide tantalum (abbreviated name: PDMA-Ta) as a material gas.

[Measurement of the Maximum Peak P (eV) of the Binding Energy of the Si2p Orbital and Atomic Compositions of the Liquid-Repellent Layer Base Film Constituting Each Nozzle Plate]

For each of the above-described liquid-repellent layer base films, XPS analysis according to the following conditions was performed, and the maximum peak P (eV) of the binding energy of the Si2p orbital and the atomic number composition are measured, and the obtained results are shown in Table II.

XPS-measuring device: Quantera SXM manufactured by ULVAC-PHI Corporation

X-ray source: Monochromatic Al Kα single color (1486.6 eV)

Detection area: 100 μmφ

Take-out angle: 45°

Detection depth: about 4 nm to 5 nm

In the nozzle plate 4 that has no liquid-repellent layer base film, XPS analysis was performed on the surface of the silicon substrate as the base film located under the liquid-repellent layer.

FIG. 9 shows an XPS spectrum of the liquid-repellent layer base film constituting each of the obtained nozzle plates.

<<Evaluation of Nozzle Plate>>

[Evaluation of Alkaline Ink Resistance]

For each of the above-prepared nozzle plates, an aqueous alkaline dummy ink having a pH 11 shown below was used, and the shape of the nozzle plate was visually observed after immersion for 1 weeks and 4 weeks at 60° C., and the alkaline ink resistance was evaluated according to the following criteria.

(Preparation of pH 11 Aqueous Alkaline Dummy Ink)

An aqueous alkaline dummy ink having a pH 11 at 25° C. is an aqueous solution containing polypropylene glycol alkyl ether and dipolypropylene glycol alkyl ether in which an aqueous sodium carbonate solution is used as a buffer solution and a pH is adjusted to 10.

(Immersion Test in Alkaline Dummy Ink)

Each of the nozzle plates thus produced was immersed in an alkaline dummy ink at 60° C., and the wettability on the liquid-repellent layer after 1 week and 4 weeks of immersion (the ink residue on the side of the ejection surface immediately after being pulled up from the ink immersion state) was visually observed, and the alkaline ink resistance was evaluated according to the following criteria.

AA: No degradation of the liquid-repellent layer is observed on the entire surface on the ejection surface side of the nozzle plate, and no residual ink on the ejection surface side is observed.

BB: Deterioration of the liquid-repellent layer has occurred on the entire surface of the nozzle plate on the ejection surface side, and the ink remaining on the exit surface side is observed.

The evaluation results obtained by the above are shown in Table II

TABLE II

| | | Liquid-repellent layer base film | | | | | | | |
|---|---|---|---|---|---|---|---|---|---|
| Nozzle Plate | Substrate | | Forming | Forming | Film Thickness | Atomic composition ratio (atomic %) | | | |
| No. | Material | No. | material | method | [nm] | Si | C | O | Ta |
| 1 | Silicon | 1 | * 1 | CVD | 108 | 15.3 | 65.2 | 19.5 | — |
| 2 | Silicon | 2 | SiC | Sputtering | 17 | 28.3 | 38.9 | 32.8 | — |
| 3 | Silicon | 3 | SiC | Sputtering | 70 | 28.2 | 41.8 | 30.0 | — |
| 4 | Silicon | — | — | — | — | — | — | — | — |
| 5 | Silicon | 4 | $SiO_2$ | Thermal oxidation | 37 | (33.3) | — | (66.6) | — |
| 6 | Silicon | 5 | * 2 | CVD | 320 | 17.3 | 44.5 | 38.2 | — |
| 7 | Silicon | 6 | * 3 | ALD | 48 | 16.3 | 1.5 | 62.3 | 19.7 |

| | Liquid-repellent layer base film XPS Binding | | Ink immersion test Ink liquid temperature: 60° C. | | |
|---|---|---|---|---|---|
| Nozzle Plate No. | Energy Peak [eV] | Liquid-repellent layer Material | After one week | After four weeks | Remarks |
| 1 | 100.4 | OPTOOL | AA | AA | Present Invention |
| 2 | 101.5 | OPTOOL | AA | AA | Present Invention |

TABLE II-continued

| | | | | | |
|---|---|---|---|---|---|
| 3 | 100.4 | OPTOOL | AA | AA | Present Invention |
| 4 | 99.4 | OPTOOL | BB | BB | Comparative Example |
| 5 | 103.5 | OPTOOL | BB | BB | Comparative Example |
| 6 | 102.3 | OPTOOL | AA | BB | Comparative Example |
| 7 | 102.1 | OPTOOL | AA | BB | Comparative Example |

* 1: TMS(Trimethylsilane)
* 2: TEOS((Tetraethoxysilane)
* 3: PDMA-Ta(Pentadimethylamide tantalum)

As indicated in Table II, it is possible to confirm that the nozzle plate composed of the structure defined in the present invention is a nozzle plate having excellent ink resistance and adhesion without deformation or peeling of the water-repellent layer or the liquid-repellent layer base film even after using an alkaline ink having a high pH and being exposed to the alkaline ink for a long time with respect to the comparative example.

In addition, when an inkjet recording apparatus provided with an inkjet head having a nozzle plate of the present invention was manufactured, and used for a long-time inkjet recording method using an alkaline ink, an inkjet head having a nozzle plate of the present invention was able to obtain a high-quality inkjet image even in continuous printing over a long period of time without causing deformation of a nozzle plate surface or ejection failure.

INDUSTRIAL APPLICABILITY

The inkjet head provided with the nozzle plate of the present invention is excellent in ink resistance and adhesion, and may be suitably used in an inkjet recording method using inks of various fields.

DESCRIPTION OF SYMBOLS

1, 40A, 40B, 40C: Nozzle plate
2, 41: Substrate
3, 42A, 42B: Liquid-repellent layer base film
4, 43: Liquid-repellent layer
10: Medium supply unit
11: Medium supply tray
12: Conveying unit
121, 122: Roller
123: Belt
20: Image forming unit
21: Imaging drum
221: Claw portion
222: Drum
22: Transfer unit
23: Temperature measuring unit
24: Head unit
241: Inkjet head
241*a*: Nozzle opening surface
2411: Nozzle
25: Heating unit
26: Delivery unit
261, 262, 264: Roller
263: Belt
30: Medium discharge unit
31: Medium discharge tray
45: Liquid-repellent layer protective film
50: Pressure chamber substrate
51: Pressure chamber
60: Vibration plate
70: Spacer substrate
71: Piezoelectric element unit
80: Wiring board
L: Maximum peak width of the binding energy of the Si2p orbital
P: Maximum peak of the binding energy of the Si2p orbital
PL: Inkjet recording apparatus
R: Recording medium
S: Surface of the liquid-repellent layer base film

What is claimed is:

1. An inkjet head comprising a nozzle plate having at least a substrate, wherein the nozzle plate has a liquid-repellent layer on an outermost surface of the substrate on an ink ejection surface side; a liquid-repellent layer base film is provided between the substrate and the liquid-repellent layer; and the liquid-repellent layer base film contains at least silicon (Si) and carbon (C), and having a maximum peak P of a binding energy of a Si2p orbital of a surface portion measured by X-ray photoelectron spectroscopy is in the range represented by the following Formula (1), $$99.6\ (\text{eV}) \leq P \leq 101.9\ (\text{eV}), \qquad \text{Formula (1)}$$

wherein the liquid-repellent layer forms a siloxane bond with the liquid-repellent layer base film by a silane coupling agent.

2. The inkjet head described in claim 1, wherein the liquid-repellent layer is a monomolecular layer.

3. The inkjet head described in claim 1, wherein the liquid-repellent layer base film is formed using silicon carbide or trimethoxysilane.

4. A method of manufacturing an inkjet head comprising the steps of:

forming a substrate having a nozzle for ejecting an ink;

forming a liquid-repellent layer base film containing at least silicon (Si) and carbon (C) on an ejection surface side of the substrate, and having a maximum peak P of a binding energy of a Si2p orbital of a surface portion measured by X-ray photoelectron spectroscopy in the range represented by the following Formula (1); and forming a liquid-repellent layer on an ejection surface side of the liquid-repellent layer base film to form a nozzle plate, $$99.6\ (\text{eV}) \leq P \leq 101.9\ (\text{eV}), \qquad \text{Formula (1)}$$

wherein the liquid-repellent layer forms a siloxane bond with the liquid-repellent layer base film by a silane coupling agent.

5. The method of manufacturing an inkjet head described in claim 4, wherein the liquid-repellent layer base film is formed using silicon carbide or trimethoxysilane.

6. An inkjet recording method comprising the step of performing inkjet image recording using the inkjet head described in claim 1 and an ink.

7. The inkjet recording method described in claim 6, wherein the ink is an alkaline ink.

* * * * *